US005342568A

United States Patent [19]

Yokota

[11] Patent Number: 5,342,568

[45] Date of Patent: Aug. 30, 1994

[54] METHOD FOR PRESTRESSING CONCRETE

[75] Inventor: Tsutomu Yokota, Inagi, Japan

[73] Assignee: Oriental Construction Company, Tokyo, Japan

[21] Appl. No.: 56,638

[22] Filed: May 3, 1993

[30] Foreign Application Priority Data

May 21, 1992 [JP] Japan ..... 4-152988

[51] Int. Cl.[5] ..... E04C 3/26; E04C 5/08

[52] U.S. Cl. ..... 264/228; 52/223.6; 254/29 A; 264/35; 264/229; 264/279; 264/279.1

[58] Field of Search ..... 264/228, 229, 261, 264, 264/263, 279, 279.1, 34, 35; 52/223.1, 223.6, 223.8, 223.11, 223.13, 223.14, 259, 745.13; 254/29 A

[56] References Cited

U.S. PATENT DOCUMENTS

| | | | |
|---|---|---|---|
| 2,328,033 | 8/1943 | Schorer | 52/223.13 |
| 2,378,584 | 6/1945 | Schorer | 264/228 X |
| 2,761,649 | 9/1956 | Woolcock | 52/223.13 |
| 2,871,554 | 2/1959 | Siegfried | 264/228 |
| 3,084,909 | 4/1963 | Carr | 52/223.13 X |
| 3,559,275 | 2/1971 | Slater | 264/262 X |
| 3,833,706 | 9/1974 | Edwards | 264/228 |
| 3,993,419 | 11/1976 | Mori et al. | 264/229 X |
| 4,245,923 | 1/1981 | Rieve | 264/229 X |
| 4,862,376 | 9/1989 | Lu | 32/223.13 X |

FOREIGN PATENT DOCUMENTS 881774 11/1961 United Kingdom ..... 52/223.13

*Primary Examiner*—Karen Aftergut

*Attorney, Agent, or Firm*—Joseph C. Mason, Jr.; Ronald E. Smith; Minoru Abe

[57] ABSTRACT

A method for introducing a prestress into a concrete member includes the steps of passing a steel rod (2) through a hollow steel rod (1), applying a tensile force to the hollow steel rod (1), while using the steel rod (2) as a reaction support member, placing concrete (4) around the hollow prestressed steel rod (1), and hardening the concrete (4). The apparatus includes a flat bearing support plate that abuts the concrete to be prestressed, a jack and ram, a rigid support member for interconnecting the jack and ram to the bearing support plate, and a holding cylinder positioned between the bearing support plate and the jack and ram. The bearing support plate and a leading end of the holding cylinder are apertured and screw threadedly receive the threaded trailing end of a hollow steel rod. The trailing end of the steel rod is screw threadedly received by the trailing end of the holding cylinder. When the ram retracts, the hollow steel rod is tensioned between the bearing support plate and the leading end of the holding cylinder.

1 Claim, 6 Drawing Sheets

METHOD FOR PRESTRESSING CONCRETE

BACKGROUND OF THE INVENTION

1. Field of the Invention

This invention relates to a method for introducing a prestress using a hollow prestressed steel rod for applying a prestress to a concrete member by means of pretensioning.

2. Description of the Prior Art

In the prior art, there are a pretensioning and a posttensioning in the methods for introducing a prestress into a precast concrete member (PC member) in which a prestressed steel is used.

The pretensioning is a main producing mode in which the pretensioning is carried out by a long-line process in a professional factory, and there is a disadvantage in that the pretensioning requires a strong abutment and a jack having a large capacity.

In the case of using the posttensioning, a fixture is necessary and generally both a sheath and grout are also required. The cost of the product becomes higher in comparison with that of pretensioning.

SUMMARY OF THE INVENTION

It is accordingly an object of the present invention to provide a method for introducing a prestress into a concrete member by using a hollow steel rod for solving the problem in the prior art pretensioning described above.

Another object of the present invention is to provide a method for introducing a prestress into a concrete member by using a hollow steel rod which enables to easily introduce a prestress into a concrete member by means of a pretensioning without using a strong abutment by passing a steel rod 2 through a hollow steel rod 1, applying a tensile force on the hollow steel rod 1 by a jack 3 while using the steel rod 2 as a reaction support member, and then by placing concrete 4 around the hollow steel rod 1 to harden the concrete 4, so that the concrete member, into which the prestress is introduced, can be produced easily at low cost and further a prestress can be introduced into the concrete member by the pretensioning even in the constructed site of a structure.

A further object of the present invention is to provide a method for introducing a prestress into a concrete member using a hollow steel rod which can be reused by placing concrete 4 around a hollow steel rod 1, hardening the resulting concrete and removing a jack 3 from the concrete immediately before curing by providing such a constitution that a bearing plate 6 and one end of a holding cylinder 7 are successively threaded onto a male screw 5 provided on the outer periphery of the end of the hollow steel rod 1, a female screw member 9 engaged with the other end of the holding cylinder 7 is threaded onto a male screw 8 provided on the end of a steel rod 2 projecting from the end of the hollow steel rod 1, the jack 3 is fixed to one end of a support member 10 having the other end connected to the bearing plate 6, and a movable member 11 of the jack 3 is engaged with the end of the steel rod 2, while a tensile force is applied to the hollow steel rod 1 by the jack 3.

A still further object of the present invention is to provide a method for introducing a prestress into a concrete member using a hollow steel rod which can be reused by pushing a steel rod 2 by a jack 3 to apply a tensile force on a hollow steel rod 1, and then removing the jack 3 before placing concrete 4 around the hollow rod 1.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
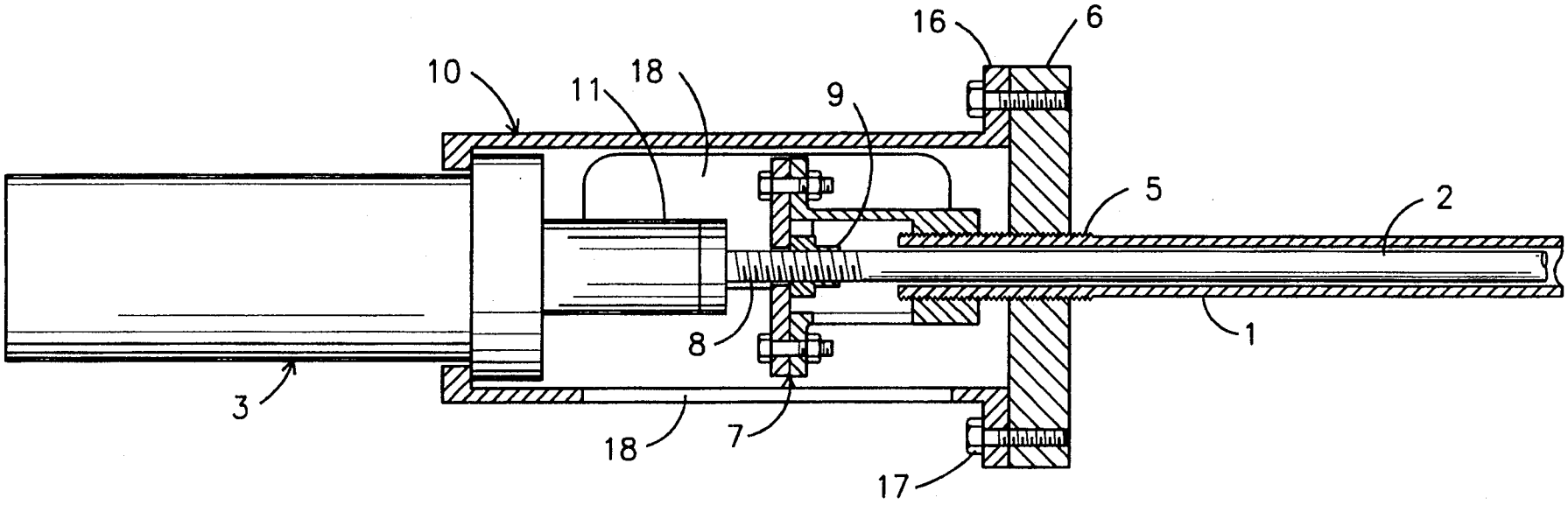
FIG. 1 is a longitudinal side view showing a condition that a device for introducing a prestress is set into a hollow steel rod as a preferred embodiment of the present invention.
Figure 2:
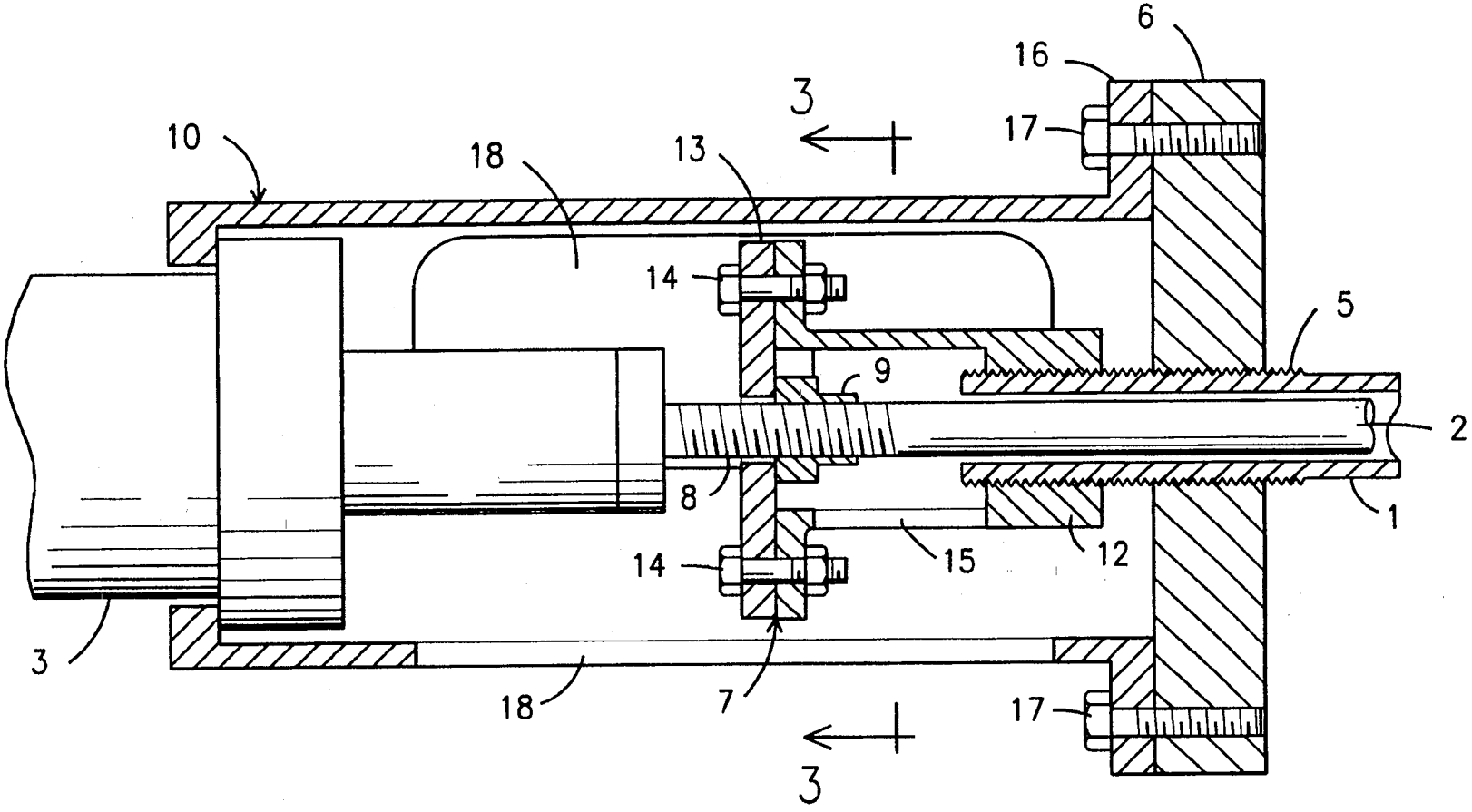
FIG. 2 is an enlarged longitudinal side view showing a portion of FIG. 1.
Figure 3:
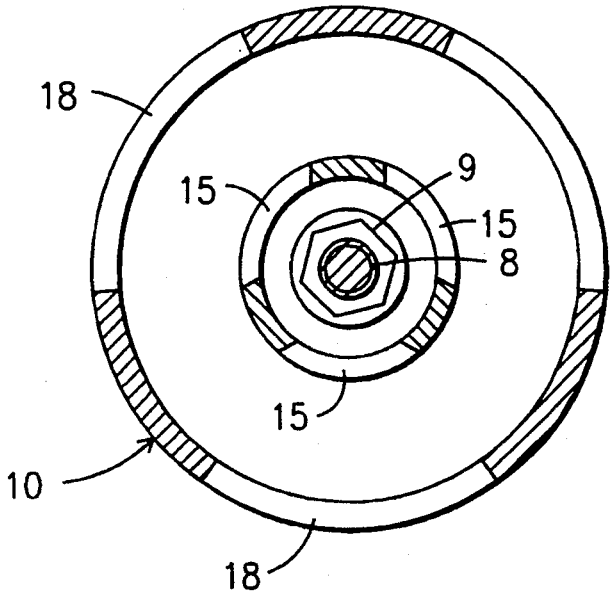
FIG. 3 is an enlarged sectional view taken along a line III—III in FIG. 2.

Referring now to FIGS. 1 through 3, the case of introducing a prestress into such a concrete member as a beam or the like will be explained in the following. First of all, a steel rod 2 is passed through a hollow steel rod 1. A male screw 5 mounted on the outer periphery of the end of the hollow rod 1 described above is threaded into a female screw at the center of a disk-shaped bearing plate 6, while it is also threaded into a female screw at one end of the main body of a holding cylinder 12. A female screw member 9 including a nut tightened to a male screw 8 mounted on the end of the steel rod 2 is provided on the other end side within the main body of the holding cylinder 12, and a holding cylinder 7 is constituted by fixing an engaging lid 13 to the other end of the main body of the holding cylinder 12 by a bolt 14. The circumferential wall of the main body of the holding cylinder 12 is provided with an opening 15 for inserting a tool for turning the female screw member 9.

Now, a flange 16 on one end of a support member 10 for supporting a hydraulic jack 3 is fixed to the bearing plate 6 by a plurality of bolts 17, and an opening 18 for inserting a turnable tool is provided in the support member 10, and a movable member 11 such as a piston rod in the jack 3 is engaged with the end of the steel rod 2.

A tensile force is given to the hollow steel rod 1 by the jack 3 by using the steel rod 2 as a reaction support member.

Figure 4:
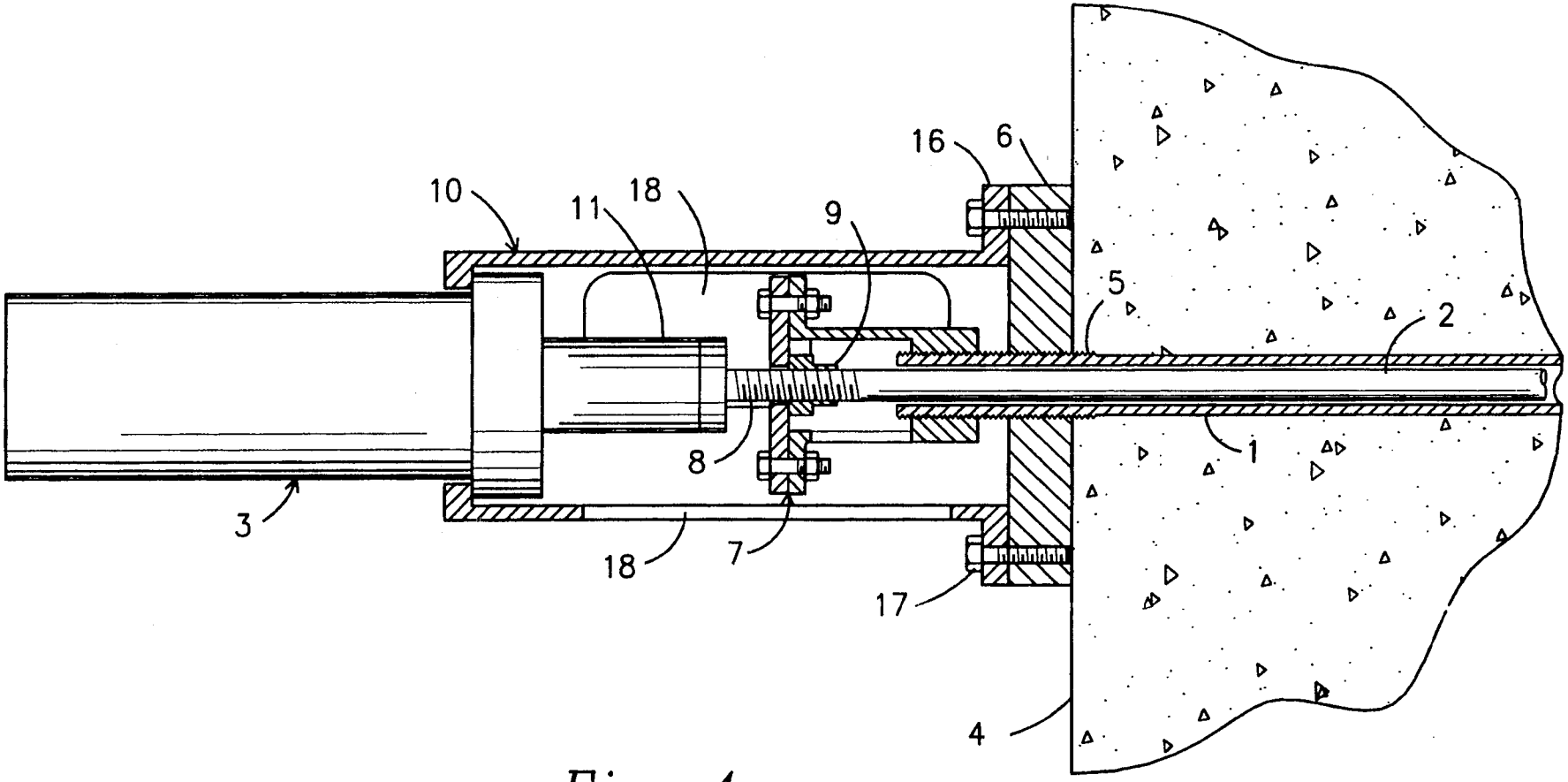
FIG. 4 is a longitudinal side view showing a condition for placing concrete around a hollow steel rod as another preferred embodiment of the present invention.

Concrete 4 constituting a beam or the like up to the position contacting the bearing plate 6 is placed under the condition that the tensile force is given to the hollow steel rod 1, as shown in FIG. 4.

Figure 5:
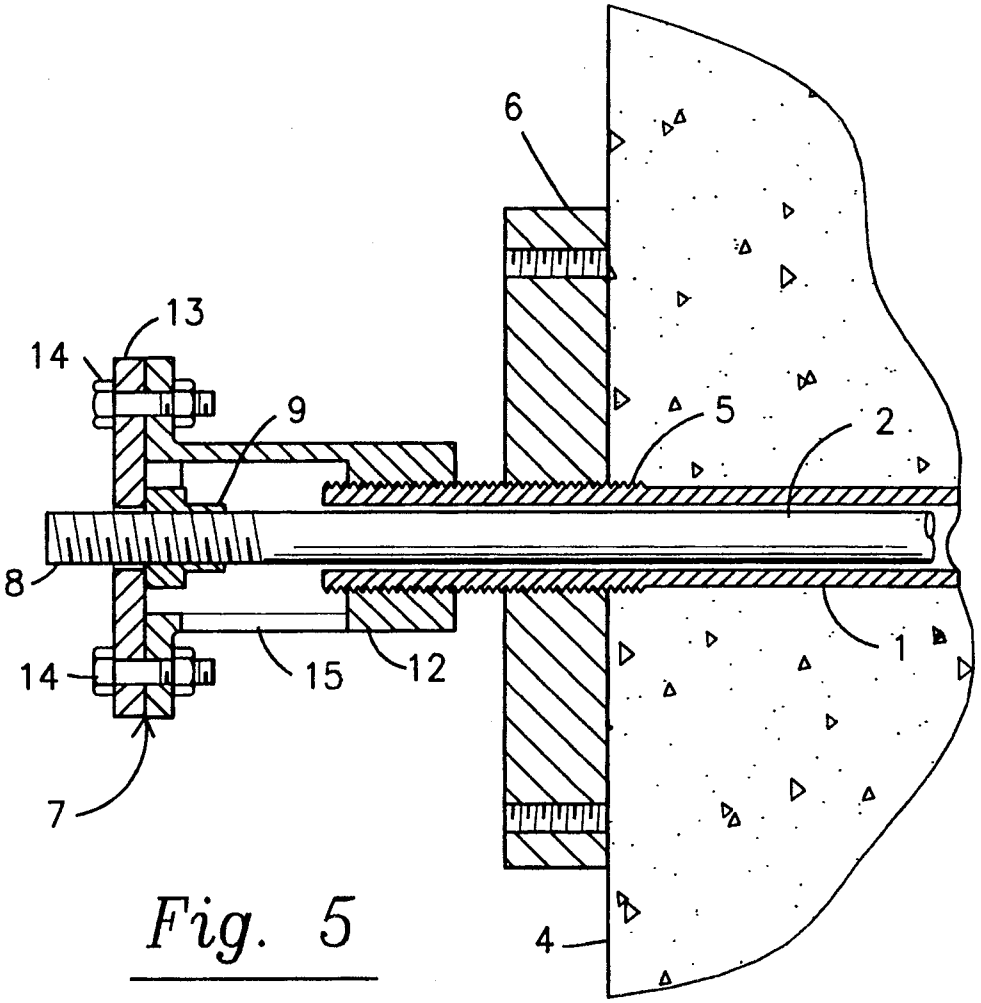
FIG. 5 is a longitudinal side view showing a condition for supporting a hollow steel rod in its stretched status by removing a jack and a support member as a further preferred embodiment of the present invention.

After the concrete 4 described above is hardened, then, the concrete 4 is cured under the condition that the jack 3 and the support member 10 are taken away, as shown in FIG. 5.

Figure 6:
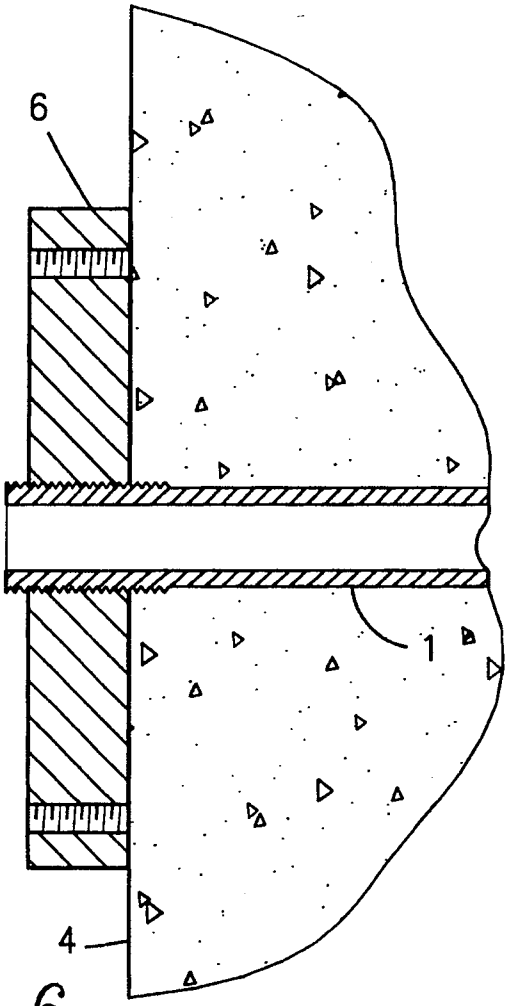
FIG. 6 is a longitudinal side view showing a condition for removing a steel rod from a hollow steel rod after the curing of concrete as a still further preferred embodiment of the present invention.
Figure 7:
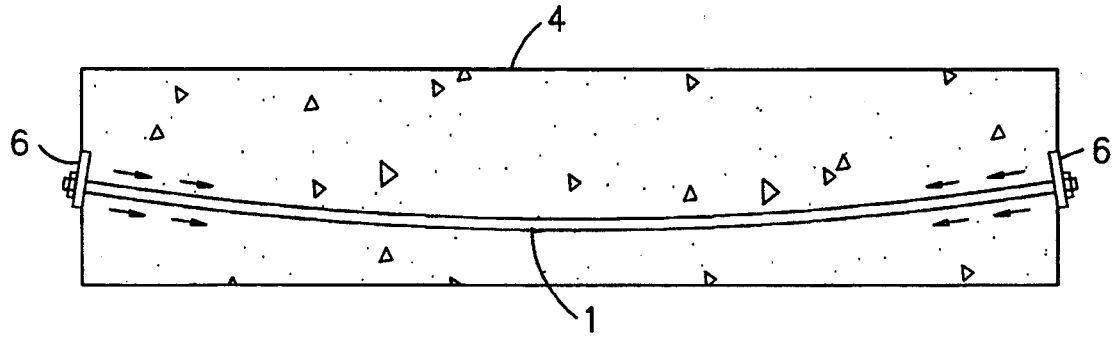
FIG. 7 is a longitudinal side view showing a concrete member into which a prestress is introduced by the method of the present invention.

After the curing of the concrete 4 is over, the holding cylinder 7 and the female screw member 9 are taken away, and the steel rod 2 is removed from the hollow steel rod 1 to give the condition as shown in FIGS. 6 and 7. Under this condition, a prestress is introduced into the concrete member such as a beam by the hollow steel rod 1. Then, the hollow steel rod 1 protruding from the bearing plate 6 is cut and removed.

Figure 8:
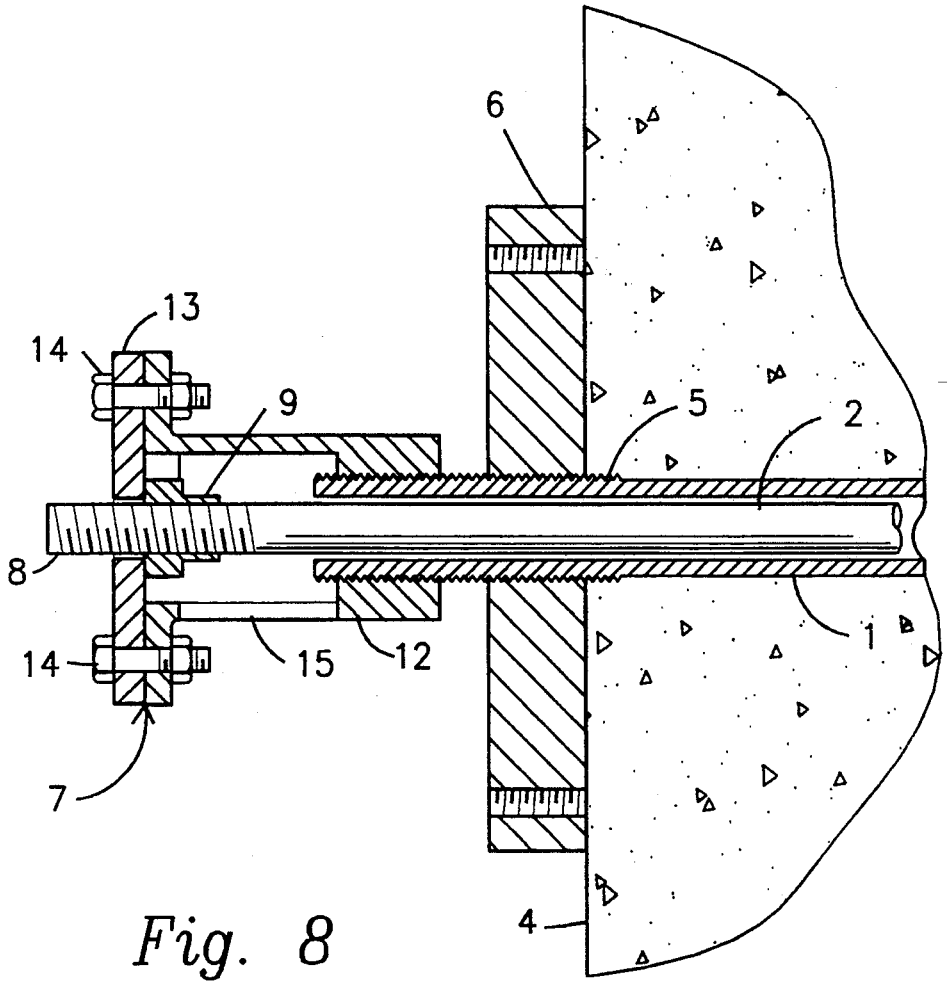
FIG. 8 is a longitudinal side view showing a method for introducing a prestress as a still further preferred embodiment of the present invention.

In the case of executing the present invention, under the condition as shown in FIG. 1, a tensile force is given to the hollow steel rod 1 by the jack 3. Then, under the condition that the female screw member 9 is engaged with the engaging lid 13 of the holding cylinder 7, the jack 3 and the support member 10 are taken away, and then, the concrete 4 may be placed around the hollow steel rod 1, as shown in FIG. 8.

In this manner, a tensile force can be given to a large member of the hollow steel rods 1 by using one jack 3 and this is economical.

In the case of executing the present invention, a deformed hollow steel rod having projections on the outer peripheral surface may be used as the hollow steel rod 1. If this kind of deformed hollow steel rod is used, its adhesion to the concrete can be reinforced.

What is claimed is:

1. A method for introducing a prestress into concrete using a hollow steel rod, comprising the steps of:

ensleeving a steel rod within a hollow steel rod;

screw threadedly engaging a bearing plate and a first end of a holding cylinder successively with a screw means mounted on a trailing end of said hollow steel rod;

screw threadedly engaging a second end of said holding cylinder with a screw means mounted on a trailing end of said steel rod, said trailing end of said steel rod projecting from said trailing end of said hollow steel rod;

providing a jack means;

rigidly interconnecting said jack means and said bearing plate with a rigid support member;

engaging a ram means of said jack to said trailing end of said steel rod; and employing said jack means to amply a tensile force to said hollow steel rod;

said steel rod serving as a reaction support means when said tensile force is applied to said hollow steel rod;

said steel rod and said hollow steel rod being embedded within said concrete during casting and curing of said concrete, said application of tensile force to said hollow steel rod thereby prestressinq said concrete.

* * * * *